United States Patent [19]

Plath

[11] Patent Number: 4,584,851

[45] Date of Patent: Apr. 29, 1986

[54] KNITTING MACHINE FOR PRODUCING MESH PRODUCTS

[75] Inventor: Ernst-Dieter Plath, Albstadt, Fed. Rep. of Germany

[73] Assignee: Sipra Patententwicklungs-und Beteiligungsgesellschaft, Albstadt, Fed. Rep. of Germany

[21] Appl. No.: 594,771

[22] Filed: Mar. 26, 1984

[30] Foreign Application Priority Data

Mar. 29, 1983 [DE] Fed. Rep. of Germany ..... 3311361

[51] Int. Cl.[4] ..... D04B 15/06; D04B 15/14

[52] U.S. Cl. ..... 66/104; 66/106; 66/115

[58] Field of Search ..... 66/54, 104, 106, 115

[56] References Cited

U.S. PATENT DOCUMENTS

| | | | |
|---|---|---|---|
| 1,952,928 | 3/1934 | Lawson | 66/54 X |
| 2,069,155 | 1/1937 | Lawson | 66/54 X |
| 2,135,187 | 11/1938 | Lawson et al. | 66/115 |
| 3,614,877 | 10/1971 | Radin | 66/54 X |
| 3,913,356 | 10/1975 | Suppe | 66/115 X |

FOREIGN PATENT DOCUMENTS

| | | | |
|---|---|---|---|
| 8203096 | 9/1982 | European Pat. Off. | 66/104 |
| 2047401 | 3/1972 | Fed. Rep. of Germany | 66/106 |
| 2642079 | 3/1978 | Fed. Rep. of Germany | 66/106 |
| 3246512 | 6/1984 | Fed. Rep. of Germany . | |
| 3321385 | 12/1984 | Fed. Rep. of Germany . | |

*Primary Examiner*—Wm. Carter Reynolds
*Attorney, Agent, or Firm*—Michael J. Striker

[57] ABSTRACT

A knitting machine has plate members and needles movable opposite to one another during sinking of the threads. The plates are of a short length and located between guide webs of a separate plate carrier, whereas the needles are longitudinally displaceable between guide webs of a needle carrier with needle shafts sliding on the free end surfaces of the guide webs of the plate carrier. Control curves for the needles and the plate members are formed so that the withdrawal movement of a needle and at least at a half needle pitch prior to the opposite driving out movement of a plate member preceding in the working direction.

5 Claims, 6 Drawing Figures

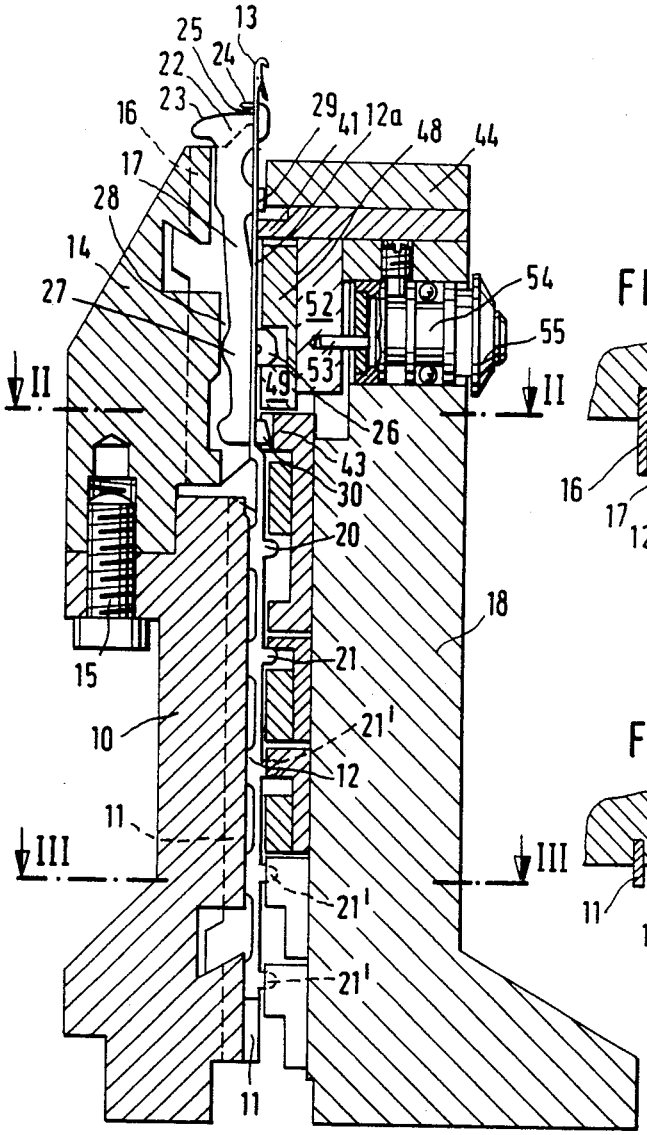
FIG. 1
FIG. 2
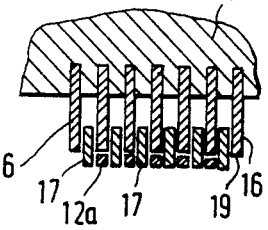
FIG. 3
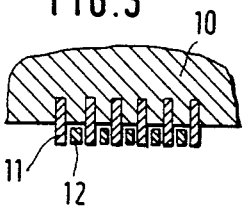

KNITTING MACHINE FOR PRODUCING MESH PRODUCTS

BACKGROUND OF THE INVENTION

The present invention relates to a knitting machine for producing mesh products. More particularly it relates to such a knitting machine which has needles and plate members (sinkers) arranged in a needle carrier alternately near to one another and controllable by separate control curves so that the plate members with their sinking edges during the withdrawing movement of the associated needles at least partially longitudinally move in an opposite direction.

It is known to facilitate the sinking process during knitting of mesh products by an opposite movement of the needles and plate members, in that the control curves for the needles and plate members can be maintained less steep and the machine can be operated faster without needle or thread breakage danger. It has been shown that after the elimination of a breakage danger for the needles in fast running machines, other problems come to the surface and endanger an unobjectionable mesh formation. These problems are first of all caused by an opposite friction of the tools cooperating with one another for handling the threads or yarns. It has been conventional, for the purpose of obtaining a relatively fine needle pitch, to arrange the needles and the plate members in pairs together in the guide grooves of a needle carrier. Thereby a separate plate carrier can be dispensed with and the plate control cam element is integrated in the needle control cam element. However, the plates and/or needles because of the oppositely running control curves with relatively great cam dimensions, are rather long and produced with respectively great mass. The opposite contact surfaces of the plate member and the needle are great and an opposite support for the needles and plate members must be forcably performed so that high friction forces take place on the tools which move relative to one another. Thereby the advantage obtained by the relative movement of the needles and the plate members is practically nullified.

SUMMARY OF THE INVENTION

Accordingly, it is an object of the present invention to provide a knitting machine of the abovementioned general type, which avoids the disadvantages of the prior art.

More particularly, it is an object of the present invention to provide a knitting machine which avoids an opposite support of needles and plate members and at the same time retains friction forces working on these tools as small as possible.

In keeping with these objects and with others which will become apparent hereinafter, one feature of the present invention resides, briefly stated, in a knitting machine in which plate members which in a known member are additionally turnable are shorter as compared with the needle length, and supported between guide webs of a separate carrier fixedly connected with the needle carrier, wherein needle shafts slide on free end surfaces of the guide webs of the plate carrier and are longitudinally movably supported in guide webs of the needle carrier so that the guide webs of the needle carrier and the guide webs of the plate carrier form gaps therebetween, and control curves for needles and plates are formed so that the withdrawal movement of a needle ends at at least half needle pitch before the opposite driving out movement of the preceding plate member in a circumferential direction.

In accordance with another advantageous feature of the present invention, for changing the mesh length, at least one displaceable outwardly adjustable driving out cam member can be provided for changing the driving out length of the plate members. Alternatively, but less advantageously, the needle pulling cam member can be formed adjustable.

In the knitting machine in accordance with the present invention, lateral forces applied upon the needles or plate members during sinking process from needle withdrawing cam member and plate member driving-out cam member are transferred to the guiding web of the needle carrier or the guiding webs of the special plate carrier. The needles and the plate members have no opposite supporting function, even when they contact at opposite sides during operation of the machine. The plate members which are longitudinally displaceably and turnably supported by these cam members are short and not massive. The needles can be designed arbitrarily long with the plate members remaining the same. This is important for a multi-system knitting machines with pattern selection devices, for which the needles must have pattern feed subdivided in several selection planes. The control curves both for the needles and for the plate members are relatively flat and maintained with weak transitions. It is provided in the inventive machine that the sinking process after one machine displacement stroke is ended by one or at most two, depending upon the sinking depth, needle pitches, and the relatively robust plate member is not subjected to strong reverse movements, which contributes to a high running quietness of the machine. The machine can operate without a plate carrier arranged normally or inclined to the needle carrier. Joint control curves can be formed in a cam element of the machine.

The mesh formation region of the machine can be maintained visible. Its construction is compact. Between the needle carrier and the cam element it is no longer necessary to have conventional fuzz collecting locations since the holding-down member for the needles, formed between plate cam parts continuously covers the remaining control region.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a view showing a radial partial section of a needle cylinder and an axial plate cylinder, as well as a cylinder cam element of a circular knitting machine in accordance with the invention;

FIG. 2 is a view showing a partial section of the edge region of the plate cylinder of FIG. 1, taken along the line II—II;

FIG. 3 is a view showing a partial section of the edge of the needle cylinder of FIG. 1, taken along the line III—III;

DESCRIPTION OF A PREFERRED EMBODIMENT

Figure 4:
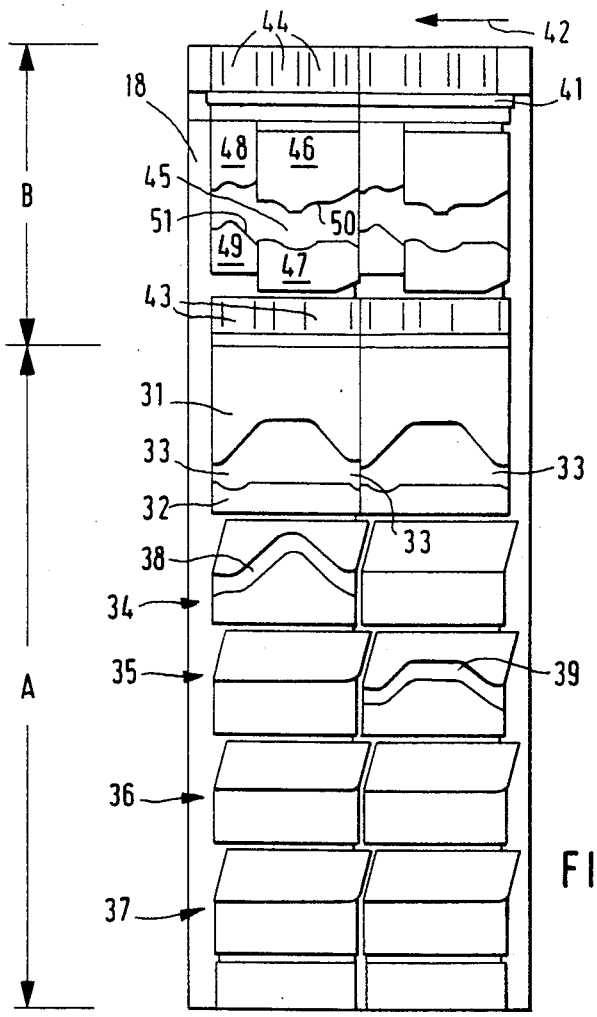
FIG. 4 is a view from inside of the cam element of the circular knitting machine over the width of the two systems.

The present invention can be used with knitting machines of any type. A circular knitting machine which is shown in the drawing as an example has only one needle carrier which is formed as a needle cylinder 10. The needle cylinder 10 has an outer surface provided with axis-parallel guide webs 11 and arranged so that shafts 12 of latch-type needles 13 are located between the webs.

Figure 6:
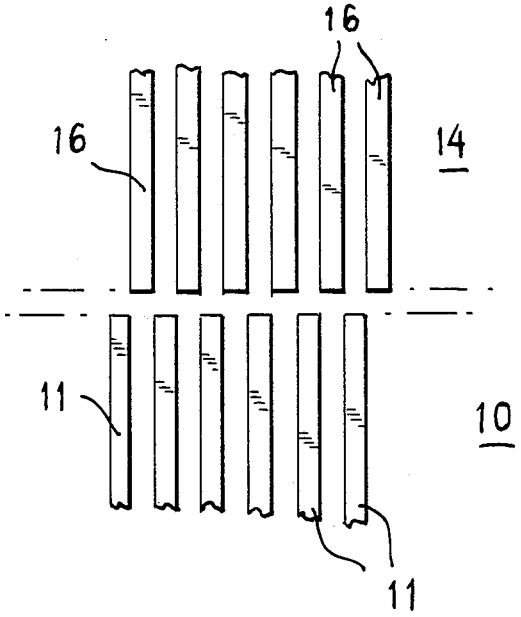
FIG. 6 is a view of guide webs of the plate and needle cylinders.

A plate cylinder 14 is arranged above the needle cylinder 10 coaxially therewith and fixedly connected with the needle cylinder 10 by screws 15. The plate cylinder 14 has an outer surface provided with also axis-parallel guide webs 16 arranged so that plate members 14 are located between the guide webs 16 in a longitudinally displaceable and turnable manner. The guide webs 16 for the plate members 17 are located in the plate cylinder 14 with the same pitch as the guide webs 11 of the needle cylinder 10. However, they are located alternately to the guide webs 11 of the needle cylinder 10 as depicted in FIG. 6. The needle cylinder 10 and the coaxial plate cylinder 14 are surrounded by a common cam element 18 which has cam members for controlling the needles 13 and the plate members 17, as will be described hereinbelow in connection with FIG. 4.

As can be seen from FIGS. 2 and 3, each of the plate members 17 is guided between two guide webs 16 whereas the long needle shaft 12 is laterally guided between two guide webs 11 of the needle cylinder 10. Each needle shaft has an upper needle shaft portion 12*a* which is located in the region of the plate cylinder 14 and extends, as shown in FIG. 2, between parts of two neighboring plates 17, the parts extending beyond a front end side 19 of the guide webs 16 of the plate cylinder 14, and beyond the end surface 19 of the guide webs 16 located between two flanking plate members 17. A lateral deflection of the needle shaft portion 12*a* in the peripheral direction of the cylinder is prevented by the neighboring plate members 17, whereas the main guidance of the needles 17 is performed by the webs 11 of the needle cylinder 10 at the long needle shaft 12. The upper needle shaft portion 12*a* slides over the front end side 19 of the guide web 16.

In the region of the long needle shaft 12, each needle is provided with a guide foot 20 and a control foot 21. In the shown embodiment the cam element 18 forms several control curves for the control feet 21 of the needles. Correspondingly the control feet of adjacent needles are arranged in four steps offset relative to one another. FIG. 1 shows in a broken line the control feet 21 in three other possible steps.

The plates (sinkers) 17 are formed as holding-down and knocking over plate members with head parts 22 characteristic of this type of the plate members. They have a sinking edge 23 over which a holding down projection 24 extends at one end with formation of a holding down throat 25. The longitudinal displacement of the plate members 17 is actuated on a central control foot 26 arranged so that at its height the plate member is supported with a projection 27 on a portion 28 of the plate cylinder 14. The turning movement of the plate member 17 is controlled by pressing feet 29 and 30, of which one pressing foot is located in the vicinity of the plate head 22 and the other pressing foot is located at the lower end of the plate member 17.

FIG. 4 shows a cam region A for controlling of the needles 13 and a cam region B for controlling of the plate members 17 on the cylinder cam element 18. The cam region A has in each system fixed cam members 31 and 32 which are provided for reliably guiding the needles 13 on their guide foot 20 at transitional positions 33 between the systems. The remaining cam region A is subdivided into four control steps 34, 35, 36, and 37 which correspond to four steps associated with the control feet 21 of the needles 13. In the four control steps 34–37 four different control curves between fixed cam members are formed, so that in the control step 34 a guide path 38 is provided with which the needles provided with the control feet 21 arranged at this step are driven to complete knitting position. In the next control step 35 a needle control curve 39 is formed in the neighboring system as shown in FIG. 4. With the aid of these control curves 39 the needles on the control foot 21 can be driven out only to its catching position. The both next control steps 36 and 37 are formed at both shown systems as circular running systems.

The cam region B for the plate members 17 has pressing cam members 43 for acting upon the pressing foot 30, and pressing members 44 for acting upon the pressing foot 29 of the plate members 17. In the region located therebetween a holding down member 41 and a longitudinal displacement-control curve 45 for the control foot 26 of the plate member 17 is provided for reliable guidance of the needle shaft portion 12*a*. This control curve is limited in each system by two fixed cam members 46 and 47 and two jointly displaceable cam members 48 and 49.

A retracting edge 50 is formed on the fixed cam part 46 and an important driving out edge 51 for the plate members 17 is formed on the displaceable cam member 49. As can be seen from the radial section in FIG. 1, the cam members 48 and 49 are jointly mounted on a cam plate 52. An eccentric pin 53 engages in the cam plate 52 and forms an end of an outwardly guided adjusting shaft 54. An adjusting disc 55 is fixedly connected with the adjusting shaft 54 and is rotatable so as to allow the longitudinal displacement of the cam plate 52 with both cam members 48 and 49 in the longitudinal displacement direction of the plate members 17 and needles 13 and thereby the driving out path of the plate members 17.

Figure 5:
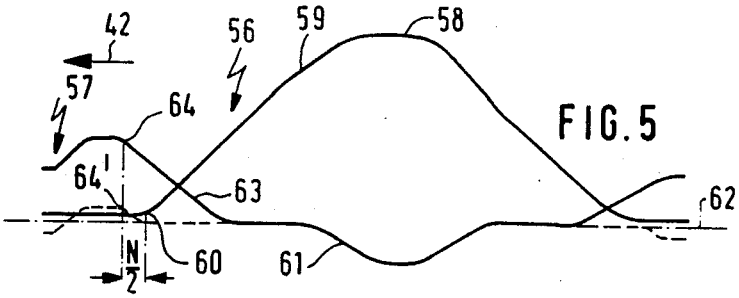
FIG. 5 is a view showing control curves for the needles and the plate members (sinkers) of the circular knitting machine of the invention.

The opposite movement of the needles 13 and the plate members 17 obtained by the cam members of the cam element in each system can be best recognized from FIG. 5 showing the respective curves. The passing through direction of the needles 13 and the plate members 17 is identified, as in FIG. 4 by an arrow 42. Both a needle curve 56 and a control curve 57 for the plate members 17 shows rounded transitional regions between the individual curve portions. At a location 58 of the needle curve 56 the needles 13 reach their highest driving out position and receive the threads. A withdrawal region 59 of the needle starts subsequently with a smooth transition and at a relatively flat angle. The withdrawal region ends practically at a location 60 of the lower weak transition region. During the withdrawal movement in the withdrawal region 59 of the needles 13, the plate members 17 in a region 61 of their control curve 57 are first lifted to a level 62 where they remain for a short time. Subsequently driving out of the plate members 17 takes place in a curve region 63, until they reach practically at a location 64 their highest driving out point determined by the adjustment of the displaceable cam members 48–49. This highest driving out point 54 of the plate members 17 is offset relative to the lowest sinking point 60 of the needles 13 at least by a half needle pitch N/2. After this, the needles remain at the level 62 until the beginning of the next needle driving out, whereas the plate member 17 is again withdrawn to the level 62. The location 64 is reached in the event of the adjusted maximum sinking length, whereas the location 64' at a curve portion shown in broken lines is attained in the event of a minimum adjusted sinking length.

It will be understood that each of the elements described above, or two or more together, may also find a useful application in other types of constructions differing from the types described above.

While the invention has been illustrated and described as embodied in a knitting machine for producing mesh products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A knitting machine for producing mesh products, comprising a needle carrier provided with guide webs; a plurality of needles longitudinally displaceably supported between said guide webs of said needle carrier; a plate carrier fixedly connected with said needle carrier and having guide webs; a plurality of turnable plate members formed shorter than said needles and supported between said guide webs of said plate carrier, said guide webs of said plate carrier having free end surfaces on which said needle shafts of said needles slide, said guide webs of said plate carrier being arranged alternately to said guide webs of said needle carrier, said plate members being guided solely by said plate carrier; and control means provided with control curves for said needles and said plate members, said control curves being formed so that a withdrawal movement of one needle ends at least one half of needle pitch before the end of an opposite driving out movement of a plate member preceding that needle in a circumferential direction.

2. A knitting machine as defined in claim 1, and further comprising at least one displaceable outwardly adjustable driving out cam part arranged for changing said driving-out movement of said plate members.

3. A knitting machine as defined in claim 1, wherein said control curves of said control means includes a control curve for said needles, and a control curve for said plate members, wherein said control curve for said plate members is formed closer to a mesh-forming region than said control curve for said needles.

4. A knitting machine as defined in claim 1, wherein each of said needles has a needle head, a needle shaft, and control feet and guide feet at said needle shaft, said control feet being located farther from said needle head than said guide feet.

5. A knitting machine as defined in claim 1, wherein said needles have heads, said control means including a plurality of cam parts for controlling said plate members; and further comprising a holding down member provided for a region of the needle shafts close to said needle heads and arranged between said cam parts.

* * * * *